United States Patent [19]

Zimmermann et al.

[11] 4,099,463

[45] Jul. 11, 1978

[54] SUPPORT ARRANGEMENT FOR GUIDING SHEETS THROUGH A PRINTING MACHINE

[75] Inventors: Hans Zimmermann, Coswig; Otfried Rudolph, Dresden; Günter Peter, Zittau; Günter Weisbach, Radebeul, all of German Democratic Rep.

[73] Assignee: VEB Polygraph Leipzig Kombinat Fuer Polygraphische Maschinen und Ausruestungen, Leipzig, German Democratic Rep.

[21] Appl. No.: 787,236

[22] Filed: Apr. 13, 1977

[51] Int. Cl.[2] ..... B41F 5/02

[52] U.S. Cl. ..... 101/230; 101/232; 271/195

[58] Field of Search ..... 271/194, 195; 101/230, 101/231, 232, 174, 175, 177, 136, 137, 142, 407 R, 407 A

[56] References Cited

U.S. PATENT DOCUMENTS

| | | | |
|---|---|---|---|
| 824,313 | 6/1906 | Scott | 271/195 |
| 1,949,001 | 2/1934 | Albrecht | 101/230 X |
| 2,933,039 | 4/1960 | Claybourn et al. | 101/183 |
| 3,334,897 | 8/1967 | Sharkey | 271/195 |
| 3,742,847 | 7/1973 | Zimmermann | 101/230 |

FOREIGN PATENT DOCUMENTS

| | | | |
|---|---|---|---|
| 458,158 | 12/1936 | United Kingdom | 271/74 |

*Primary Examiner*—J. Reed Fisher
*Attorney, Agent, or Firm*—Michael J. Striker

[57] ABSTRACT

A printing machine has a plurality of printing stations which print images on both major surfaces of each sheet passing through the printing machine. A reversing arrangement turns the respective sheet between two of the printing stations so that the major surface of the respective sheet having a fresh image thereon faces downwardly. A support arrangement is provided which supports this sheet during its advancement to the next following printing station, and includes a blow casing having upwardly oriented passages through which air issues in upward direction to create an air cushion between the respective sheet and the blow casing for supporting the respective sheet during its advancement. An elongated bracket is arranged upwardly of the blow casing and supports a region of the respective sheet which is devoid of the image, during the advancement of the sheet in a path portion located upwardly of the blow casing. The position of the bracket in the transverse direction of the machine is adjustable by means of a drive and a transmission which includes a transmission shaft having several sections interconnected by an elastic coupling. The blow casing is curved, and the number of the apertures per unit area within the curved portion and within the lateral portions of the blow casing exceeds that without such portions.

9 Claims, 5 Drawing Figures

FIG. 4
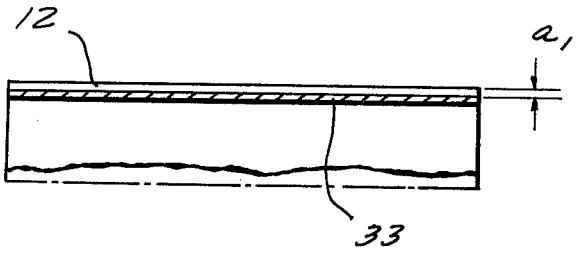
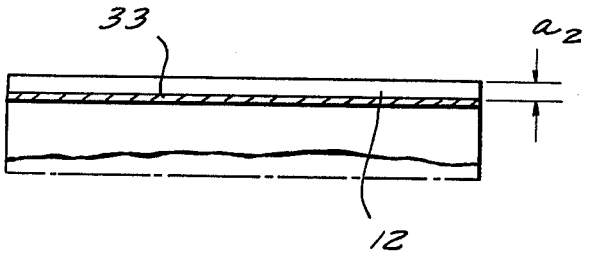
FIG. 5

SUPPORT ARRANGEMENT FOR GUIDING SHEETS THROUGH A PRINTING MACHINE

BACKGROUND OF THE INVENTION

The present invention relates to sheet support and guiding arrangement in general, and more particularly to such arrangements for use in printing machines which print images on both major surfaces of sheets passing therethrough.

Printing machines of the above-mentioned type are already known and in widespread use so that they need no detailed discussion. Suffice it to say that they include a plurality of printing stations which print images first on one side of the respective sheet and then on the other side. Thus, the respective sheet is to be turned or reversed as it passes from the printing station or printing stations which print images on one of the sides or major surfaces of the respective sheet, to the printing station or printing stations which print images on the other side or major surface of such sheet. Reversing arrangements for turning the sheets are also already known, among them such which work according to the principle of turning the trailing end of the respective sheet. During or following the turning of the respective sheet, and during the subsequent advancement of the respective sheet from one of the printing stations to the next following one, the major surface of the respective sheet which has a fresh printed image thereon faces downwardly so that, when the downwardly facing major surface, and particularly the fresh image printed thereon, is allowed to come into contact with sheet-guiding arrangements, there exists the danger that the fresh image may become smeared or blurred due to the sliding contact of the image with the sheet guide arrangements or elements during the relative movement of the respective sheet with respect to the guide arrangements.

In an attempt to avoid this danger, it has been already proposed to use, in printing machines of the type printing images on both major surfaces of the sheets, such arrangements for supporting and guiding the respective sheets which include hollow sheet-guiding brackets arranged at the printing stations, through and from which air is blown underneath the advancing sheet so that the sheet is suspended above the sheet-guiding brackets by the air issuing from the latter, following the turning of the sheet, in order to avoid smearing of the freshly printed image.

This proposed arrangement is disadvantageous in several respects. First of all, a pronounced disadvantage is that too much of the air being blown against the sheet escapes underneath the sheet so that there is no chance of formation of an air cushion for supporting the sheet. In order to achieve the desired effect nevertheless, considerable amounts of air must be blown out of the outlet apertures of the sheet-guiding brackets, which amounts of air can be produced only at a great expenditure in terms of capital investment and operating expenses. An additional disadvantage of this proposed arrangement is that the substantial amount of air blown against the sheet brings about the danger that the marginal portions of the sheet will be turned over and, during the subsequent printing operation, the turned-over portions of the sheet will be fixed in their positions, resulting in the formation of folds and creases on the sheet. A further disadvantage of this arrangement is to be seen in the fact that sheets of heavy paper cannot be treated in a printing machine equipped with such an arrangement because of their high unit weight, in that such sheets, despite the localized air stream, "stall" or drop onto the sheet-guiding brackets and thus the images printed on the downwardly facing major surface of the respective sheet become smeared or obliterated. Furthermore, the advancement of the sheets during the printing on the first side of the sheet is unsteady due to the absence of closed guiding baffles.

SUMMARY OF THE INVENTION

Accordingly, it is a general object of the present invention to avoid the disadvantages of the prior art.

More particularly, it is an object of the present invention to provide a support arrangement for guiding sheets through printing machines which is not possessed of the disadvantages of prior-art guiding or support arrangements.

A further object of the present invention is to provide a support arrangement of the above-mentioned type which is especially suited for use in printing machines which print images on both major surfaces of the respective sheets passing therethrough.

A concomitant object of the present invention is to so design the support arrangement that it is capable of handling sheets of different unit weights.

A still another object of the present invention is to provide a support arrangement which is simple in construction, reliable in operation and inexpensive to manufacture.

A yet further object of the present invention is to provide a support arrangement capable of handling sheets the different dimensions, which avoids the dangers of smearing of freshly printed images and of the formation of creases or folds.

In pursuance of these objects and others which will become apparent hereafter, one feature of the present invention resides, in a printing machine, briefly stated, in a combination comprising a plurality of printing stations for printing images on major surfaces of sheets passing therethrough; means for advancing the sheets in a predetermined path through and between the printing stations; and means for supporting each respective sheet from below during the advancement thereof in at least one portion of the above-mentioned path, including a blow casing extending over the entire width of the machine and along the above-mentioned path portion underneath the same and having a plurality of upwardly oriented apertures through which a pressurized gaseous medium issues from the interior of the blow casing toward the path portion at least during the advancement of the respective sheets in such path portion. In addition thereto, the supporting means includes at least one sheet-guiding bracket arranged intermediate the blow casing and a zone of the path portion.

The advancing means may include at least one reversing arrangement for turning the respective sheet intermediate two of the printing stations so that a respective major surface of the respective sheet having a freshly printed image thereon faces downwardly; then, the above-mentioned path portion is located at and downstream of the reversing arrangement. The respective major surface of the respective sheet has a continuous region which extends in the direction of advancement of the respective sheet and which is devoid of the image, the bracket being elongated and extending in the above-mentioned direction in juxtaposition with the continuous region of the respective major surface of the respective sheet. To adjust the position of the bracket into juxtaposition with the continuous region of the respective major surface of the respective sheet, the supporting means further includes means for mounting the bracket on the machine for displacement transversely thereof.

According to a further aspect of the present invention, the advancing means further includes at least one transfer drum intermediate the printing stations and operative for transferring the respective sheet from one to another of the printing stations, and the reversing arrangement includes a reversing drum. Then, at least one of the drums includes a drum cap extending at both sides within and extending short of the periphery of the particular drum.

In a currently preferred embodiment of the present invention, the above-mentioned means for mounting the bracket on the machine for displacement transversely thereof includes at least one cross-beam extending transversely of the machine, and at least one carriage mounted on the cross-beam for displacement longitudinally thereof.

Furthermore, a drive is provided, and transmission means is arranged between the drive and the carriage and is operative for displacing the latter in response to energization of the former. Such transmission means may include at least one chain connected to the carriage and to the drive for displacement in response to the energization of the latter. On the other hand, the transmission means may include a transmission shaft, a first chain interposed between the drive and the transmission shaft and operative for rotating the latter in response to the energization of the former, and a second chain connected to the carriage and trained about the transmission shaft and operative for displacing the former in response to the rotation of the latter.

The transmission shaft may consist of at least two shaft sections mounted in the respective printing stations of the printing machine for rotation; then, the transmission means may include an elastic coupling operative for rotating the shaft sections in unison and for detaching one of the shaft sections from the other for disassembling at least one of the printing stations from the remainder of the printing machine.

In a currently preferred embodiment of the present invention, the blow casing has a curved portion and lateral portions, and the number of the apertures within the portions per unit area exceeds that without such portions.

The advantage of this particular construction of the arrangement of the present invention is that all sheet-guiding brackets provided throughout the printing machine and aligned with one another in the direction of advancement of the sheets can be simultaneously and positively brought in the desired positions in only one adjusting operation. As a result of the combination of the blow casing with the sheet-guiding bracket mounted thereabove, and of the provision of the reversing and/or transferring drums with drum caps, a technically and economically advantageous variant to sheet advancement has been realized which is characterized by the fact that it is now possible to obtain high-quality treatment of all kinds of paper sheets, from thin paper sheets up to cardboard, with a low technical and economical expenditure.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 is a sectional front view of the drum cap along line A—A of FIG. 1; and FIG. 5 is a sectional front view of the drum cap along line B—B of FIG. 1.

DETAILED DISCUSSION OF THE PREFERRED EMBODIMENT

Figure 1:
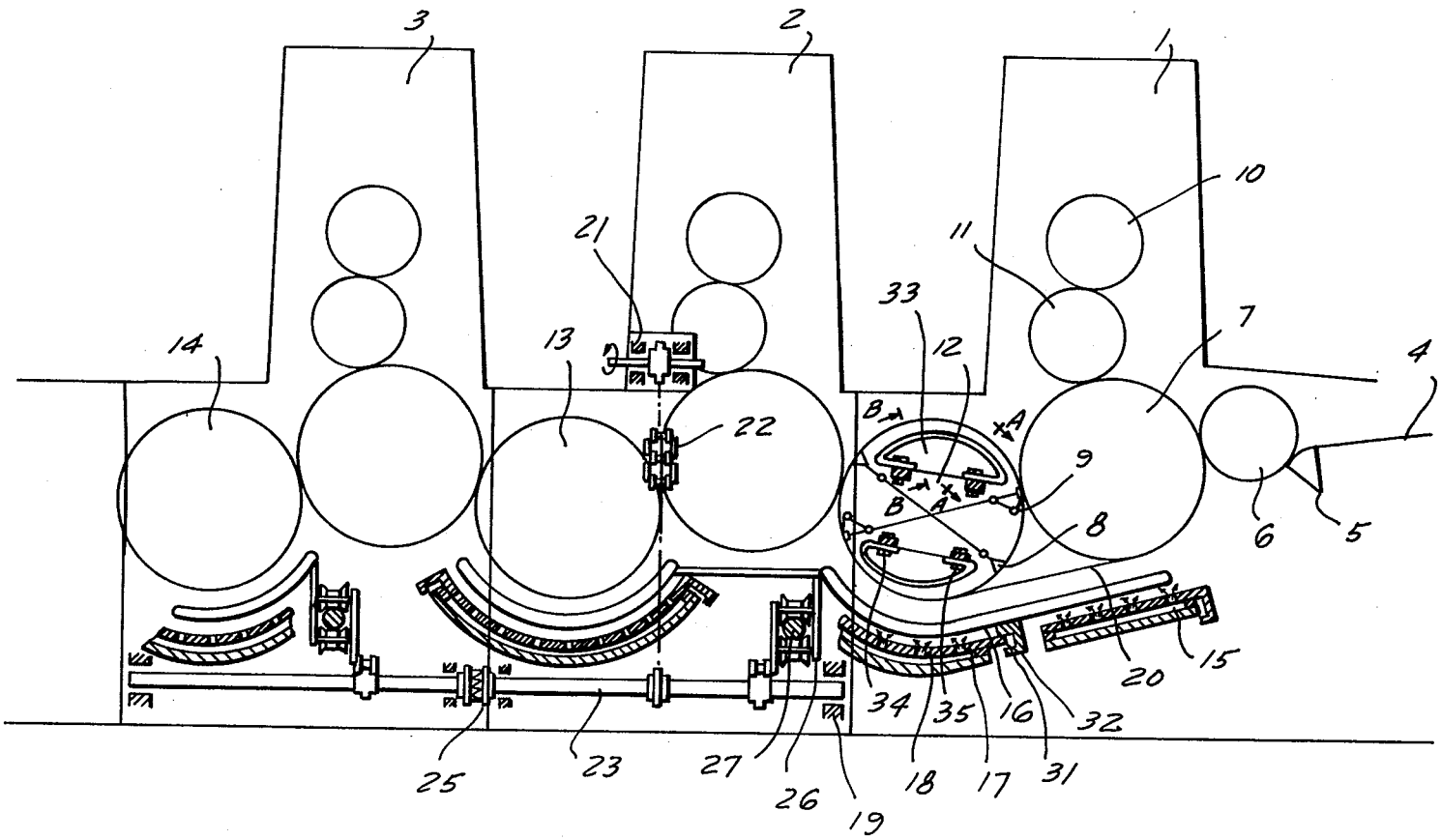
FIG. 1 is a somewhat diagrammatic view of the support arrangement of the present invention as incorporated in a printing machine of the type capable of printing images on both major surfaces of sheets passing therethrough.
Figure 2:
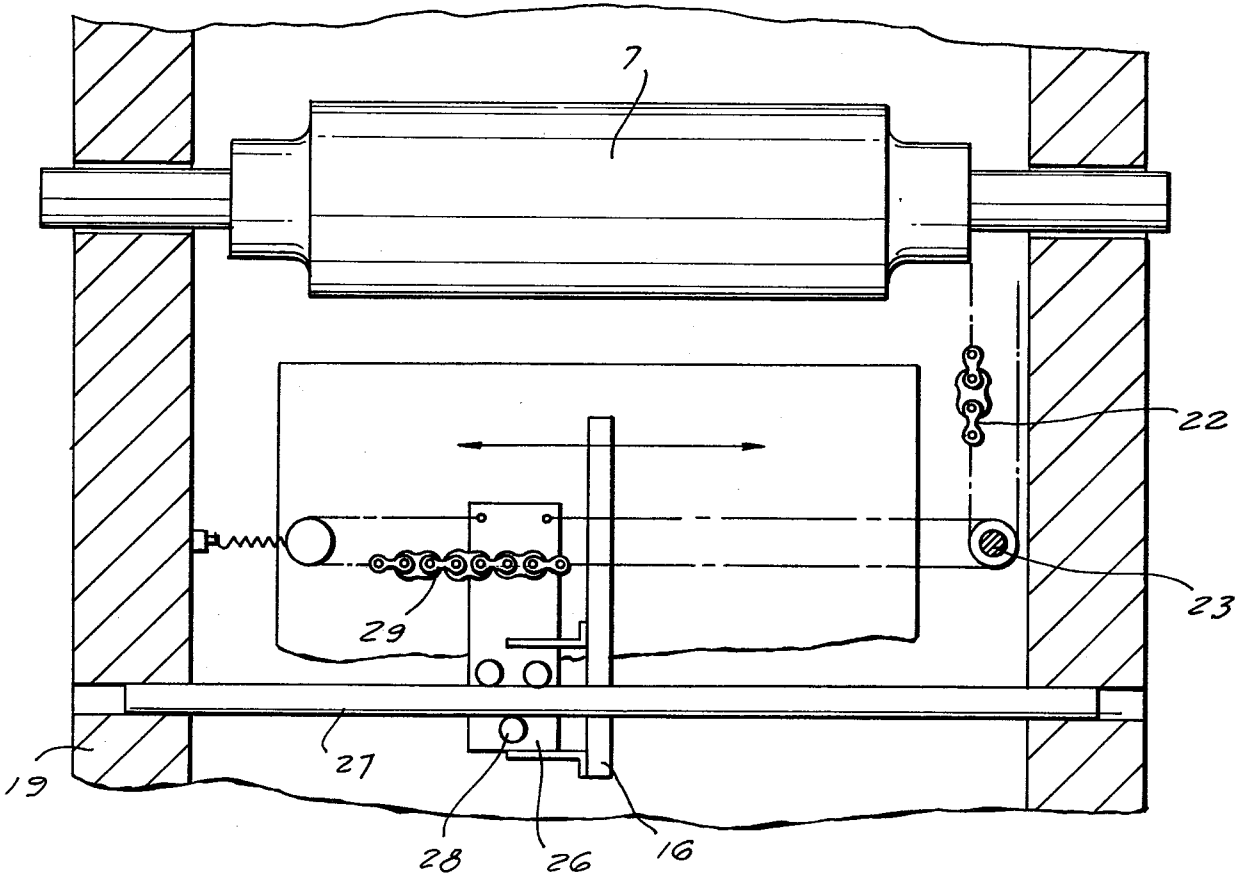
FIG. 2 is a lateral view of an adjusting arrangement for a sheet-guiding bracket, as used in the machine of FIG. 1.

Referring now to the drawings in detail, and first to FIG. 1 thereof, it may be seen therein how the arrangement of the present invention is incorporated in a printing machine. The printing machine, as illustrated, includes three printing stations 1, 2 and 3 of which the printing station 1 is at the upstream end of the machine, while the printing station 3 is at the downstream end of the machine. A feeding arrangement is arranged upstream of the printing station 1 and includes a feeding table 4, a gripping arrangement 5 and a presenting roller 6. The printing station 1 is illustrated as having a pressing cylinder 7, a printing plate supporting cylinder 10 and a rubber cylinder 11. The printing stations 2 and 3 also have similar cylinders. The printing stations 1, 2 and 3 are connected with one another by sheet-transfer drums 12, 13 and 14. The upstream sheet-transfer drum 12 is constructed as a reversing drum equipped with two correlated cooperating gripper systems 8 and 9 consisting, respectively, of a row of suction grippers and of a row of clamping grippers. Reversing drums of this type are known in the art so that the reversing drum has been only schematically indicated.

Figure 3:
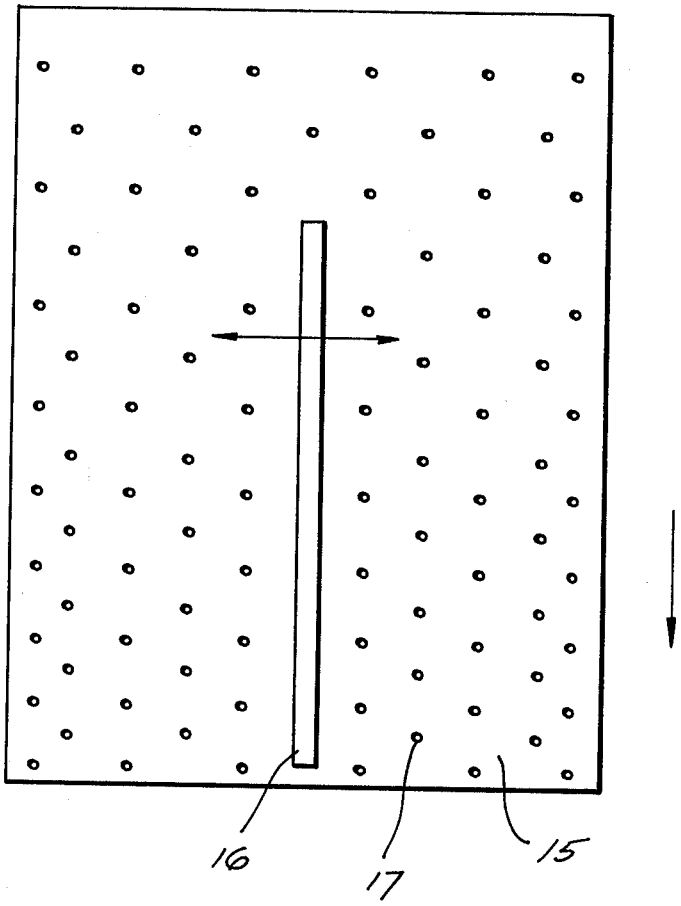
FIG. 3 is a top plan view of a blow casing and a sheet-guiding bracket.

Blow casings 15 which extend over the entire width of the machine and which are accommodated to the desired path of movement of the sheets, are arranged underneath the printing stations 1, 2 and 3. The blow casings 15 are closed at all sides, except for the upper part or top of each blow casing 15 which is provided with a plurality of upwardly oriented outlet apertures 17 through which air admitted into the interior of the respective blow casing 15 from a non-illustrated source issues in the upward direction. As illustrated in FIG. 3, a larger number of the apertures 17 per unit area is provided at the lateral and curved regions of the respective blow casing 15, than at the remaining regions.

A sheet-guiding bracket 16 is arranged above each of the blow casings 15, and the brackets 16 associated with the blow casings 15 are aligned with one another in the direction of advancement of the sheets through the printing machine. In other words, all of the brackets 16 are juxtaposed with the same region of the respective sheet during the advancement of the latter in a predetermined path through the printing machine. The brackets 16 are coupled with one another and are adjustable in the transverse direction of the machine. An adjusting drive 21 serves to adjust the positions of the brackets 16, the drive 21 being mounted on the printing station 2 and being constructed in a conventional manner. The drive 21 is connected, by means of a flat-link chain 22, with a transmission shaft 23 mounted in bearings 19 of the machine.

Each of the sheet-guiding brackets 16 is mounted on a carriage 26 which is mounted on a cross-beam 27 for displacement longitudinally of the cross-beam 27. An adjusting chain 29 connects the carriage 26 with the transmission shaft 23. Guides 31 are mounted on the blow casings 15, and support elements 32 connected to the brackets 15 are guided on the guides 31 during the transverse adjustment of the position of the respective brackets 16.

In an embodiment of the present invention which has not been illustrated, the flat link chain 22 can be directly connected to the carriage 26. This is advantageous in such circumstances when it is intended to treat high-weight paper sheets, or in machines for printing on sheets of large dimensions, where a plurality of sheet-guiding brackets 16 is provided adjacent one another in the transverse direction of the machine, and where the coupling of the various carriages 26 associated with the various brackets 15 arranged between different printing stations by means of the transmission shaft 23 is not advantageous.

In order to preserve the possibility of separating the various components of the printing machine, the transmission shaft 23 is equipped with an elastic coupling 25 arranged at the separation plane 24 between the stations 2 and 3.

The sheet-transfer drum 12 is provided at both sides with a sheet-metal drum cap 33. The sheet-transfer drum 12 has transverse beams 35, and bolts 34 connect the respective drum caps 33 to the transverse beams 35. The drum cap 33 is accommodated in its entirety within the perimeter of the sheet-transfer drum 12 and is inwardly spaced from the periphery of the sheet-transfer drum 12.

As particularly clearly seen in FIGS. 4 and 5, the spacing of the drum cap 33 from the periphery of the sheet-transfer drum 12 changes. In FIG. 4, this spacing is indicated as $a_1$ and is smaller than a spacing $a_2$ shown in FIG. 5. As seen in FIG. 1, the spacing of the radially outward surface of the drum cap 33 from the periphery of the sheet-transfer drum gradually increases from $a_1$ to $a_2$.

Having so described the construction of the present invention, the operation thereof will now be briefly discussed.

A respective sheet 20 first travels over the feeding table 4 until it reaches the gripping arrangement 5 to be gripped thereby and transferred to the sheet-presenting cylinder 6, from where it advances around the pressing cylinder 7 to be printed thereon. Subsequently thereto, the respective sheet 20 is turned, in a known manner, by means of the suction and clamping gripper rows 8 and 9 which operate in correlation with one another, and then the sheet 20 is delivered to the subsequent printing stations 2 and 3 to be printed with images at the reverse side thereof.

During or following the turning, the sheet 20 is so positioned that the major surface thereof which has a fresh image printed thereon in the printing station 1, faces downwardly, that is, away from the reversing drum 12 or away from the sheet-transfer drum 13, 14. In order to avoid the smearing of the freshly printed image on the downwardly facing major surface of the sheet 20, the latter is suspended, during the advancement thereof, on an air cushion which is formed by the air issuing from the outlet apertures 17 of the blow casing 15.

As a result of the presence of a greater number of apertures 17 per unit area at the portions of the blow casing 15 where the latter has a pronounced curvature, and at the lateral portions of the blow casing 15 which are juxtaposed with the lateral regions of the sheet 20 during the advancement of the latter, a more pronounced and more strongly supporting air cushion is formed above such portions than above the other remaining portions of the blow casing 15.

In addition thereto and simultaneously therewith, the sheet 20 is guided and supported on the sheet-guiding bracket 16 which is arranged above the blow casing 15 in the aligned selected position thereof. The sheet-guiding bracket 16 is adjusted in its position to be juxtaposed with continuous regions of the sheet 20 which are devoid of printed images.

As a result of the special construction of the reversing drum 12 and/or of the sheet-transferring drums 13 and 14 which are equipped with the drum caps 33, there is achieved an aerodynamically optimum behaviuor of the sheet 20 during the advancement thereof in that the drum caps 33 of the respective drum 12, 13, or 14, because of their configuration, augment the action of the air cushion on the sheet 20 during the operation of the arrangement.

When it is necessary to adjust the position of the sheet-guiding bracket 16 in the transverse direction of the machine, such as during switching from one printing operation to another, such an adjustment is achieved by energizing the drive 21 in the desired sense. When the drive 21 is so energized, the flat-link chain 22 will rotate the transmission shaft 23 which, in turn, will displace the chain 29 connected to the carriage 26 so that the latter will be moved along the cross-beam 27 in the appropriate direction. It will be understood that the connection of the chains 22 and 29 to the drive 21, the transmission shaft 23 and to the carriage 26 is achieved in a conventional manner, such as by training the chains 22 and 29 about sprockets.

When a plurality of transversely adjacent sheet-guiding brackets 16 is provided, they are adjusted directly by the flat-link chain 22. On the other hand, when the sheet-guiding brackets 16 are all coupled to the drive 21 via the transmission shaft 23, it is possible to bring all of the mutually aligned sheet-guiding brackets 16 simultaneously and only in a single operation in the respectively desired positions.

It will be understood that each of the elements described above, or two or more together, may also find a useful application in other types of constructions differing from the types described above.

While the invention has been illustrated and described as embodied in a support arrangement for printing machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a printing machine, a combination comprising a plurality of printing stations for printing images on major surfaces of sheets passing therethrough; means for advancing the sheets in a predetermined path through and between said printing stations including at least one transfer drum intermediate said printing stations and operative for transferring the respective sheet from one to another of said printing stations, and means for so reversing the respective sheet intermediate two of said printing stations that a respective major surface of the respective sheet having a freshly printed image thereon faces downwardly, including a reversing drum, at least one of said drums including a drum cap located within and extending at both sides short of the periphery of said one drum; and means for supporting each respective sheet from below during the advancement thereof in at least one portion of said path which is located at and downstream of said reversing means, including a blow casing extending over the entire width of the machine and along said path portion underneath the same and having a plurality of upwardly oriented apertures through which a pressurized gaseous medium issues from the interior of said blow casing toward said path portion at least during the advancement of the respective sheet in the latter, and at least one sheet-guiding bracket arranged intermediate said blow casing and at least a zone of said path portion.

2. In a printing machine, a combination comprising a plurality of printing stations for printing images on major surfaces of sheets passing therethrough; means for advancing the sheets in a predetermined path through and between said printing stations; and means for supporting each respective sheet from below during the advancement thereof in at least one portion of said path, including a blow casing extending over the entire width of the machine and along said path portion underneath the same and having a plurality of upwardly oriented apertures through which a pressurized gaseous medium issues from the interior of said blow casing toward said path portion at least during the advancement of the respective sheet in the latter, at least one sheet-guiding bracket arranged intermediate said blow casing and at least a zone of said path portion, and means for mounting said bracket on said machine for displacement transversely thereof, including at least one cross-beam extending transversely of the machine, and at least one carriage mounted on said cross-beam for displacement longitudinally thereof.

3. A combination as defined in claim 2; and further comprising a drive; and transmission means arranged between said drive and said carriage and operative for displacing the latter in response to energization of the former.

4. A combination as defined in claim 2, wherein said transmission means includes at least one chain connected to said carriage and to said drive for displacement in response to the energization of the latter.

5. A combination as defined in claim 2, wherein said transmission means includes a transmission shaft; a first chain interposed between said drive and said transmission shaft and operative for rotating the latter in response to the energization of the former; and a second chain connected to said carriage and trained about said transmission shaft and operative for displacing the former in response to the rotation of the latter.

6. A combination as defined in claim 2, wherein said transmission shaft has at least two shaft sections mounted in the respective printing stations of the printing machine for rotation; and wherein said transmission means further includes an elastic coupling operative for rotating said shaft sections in unison and for detaching one of said shaft sections from the other for disassembling at least one of said printing stations from the remainder of the printing machine.

7. In a printing machine, a combination comprising a plurality of printing stations each including means for advancing a plurality of sheets through the respective printing station in an advancement direction and for printing on a respective major surface of a respective sheet an image that is adjoined by an unprinted region which is free of any printed image and which extends continuously in said advancement direction; means for so transferring the respective sheet in said advancement direction between said printing stations that the respective major surface which has a freshly printed image thereon faces downwardly during the advancement of the respective sheet in at least one path portion; and means for supporting the respective sheet from below during the advancement thereof in said path portion, including a blow casing extending over the entire width of the machine and along said path portion underneath the same and having one wall provided with a plurality of upwardly oriented apertures through which a pressurized gaseous medium issues from the interior of the blow casing toward said path portion at least during the advancement of the respective sheet in the latter, and at least one elongated sheet-guiding bracket arranged intermediate said blow casing and said path portion and extending in said advancement direction and in juxtaposition with only said unprinted region of the respective major surface so as to avoid contact of said bracket with and resultant smearing of the freshly printed image.

8. A combination as defined in claim 7, wherein said supporting means further includes means for mounting said bracket on the machine for displacement transversely thereof for adjusting the position of said bracket into juxtaposition with the unprinted region of the respective major surface of the respective sheet.

9. A combination as defined in claim 7, wherein said one wall of said blow casing has a first section including a curved portion extending transversely of the machine and lateral portions extending parallel to said advancement direction, and a second section including the remainder of said one wall; and wherein the number of said apertures per unit area within said first section exceeds that within said second section.

* * * * *